US007293515B2

(12) United States Patent
Omiya et al.

(10) Patent No.: US 7,293,515 B2
(45) Date of Patent: Nov. 13, 2007

(54) EMBROIDERY SEWING MACHINE

(75) Inventors: Koshiro Omiya, Tokyo (JP); Masashi Ninomiya, Tokyo (JP); Shuzo Morimoto, Tokyo (JP); Tsutomu Takagi, Tokyo (JP); Akira Orii, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 11/442,486

(22) Filed: May 26, 2006

(65) Prior Publication Data

US 2006/0278147 A1 Dec. 14, 2006

(30) Foreign Application Priority Data

Jun. 10, 2005 (JP) ..... 2005-170729
Jun. 10, 2005 (JP) ..... 2005-170730
Jun. 10, 2005 (JP) ..... 2005-170731

(51) Int. Cl.
*D05B 21/00* (2006.01)
*D05C 9/00* (2006.01)

(52) U.S. Cl. ..... 112/470.18

(58) Field of Classification Search ..... 112/103, 112/102.5, 470.18, 258, 260
See application file for complete search history.

(56) References Cited

U.S. PATENT DOCUMENTS 4,036,158 A * 7/1977 Fresard et al. ..... 112/258
5,040,476 A * 8/1991 Takenoya et al. ..... 112/102.5
5,692,449 A * 12/1997 Meier ..... 112/470.18
6,158,365 A * 12/2000 Hidechika et al. ..... 112/103
6,802,272 B2 * 10/2004 Ebata et al. ..... 112/102.5
2002/0083872 A1 7/2002 Tippl et al. ..... 112/80.3

FOREIGN PATENT DOCUMENTS

JP 2000-237478 9/2000

* cited by examiner

*Primary Examiner*—Ismael Izaguirre
(74) *Attorney, Agent, or Firm*—Nields & Lemack

(57) ABSTRACT

Embroidery sewing machine having a Y-direction drive mechanism including an elongated arm which is normally accommodated in a cutout portion formed at a bed of the machine body and forms a part of that body. The upper side of the arm is continuous with the upper side of the bed in a same plane. The arm has a frame support to which an embroidery frame is removably attached, the frame holding a work to be embroidered. The arm is arranged as turnable to extend from the rear side of the bed into the depth direction (Y-direction) of the machine, where the arm is operative for embroidery stitching. The arm is connected to an X-direction drive mechanism arranged in the machine body and may be moved in the width direction (X-direction) of the machine body, by the X-direction drive mechanism while the embroidery frame is moved in the Y-direction along the arm.

18 Claims, 16 Drawing Sheets

EMBROIDERY SEWING MACHINE

BACKGROUND OF THE INVENTION

FIELD OF THE INVENTION

The present invention relates to a sewing machine and more particularly relates to an embroidery sewing machine.

Generally the embroidery sewing machine includes an embroidering frame which holds a cloth to be stitched and is moved in the X-Y directions relative to the machine needle so that an embroidery pattern may be stitched on the cloth. In this connection, it is known that there are two types of embroidery sewing machines. In one type of the machines, the X-Y direction drive mechanism is formed separately from the machine body and is connected to the machine body at the outside thereof when the embroidery stitching operation is performed. This type may be called a machine of exterior mechanism. In the other type of the machines, the X-Y direction drive mechanism is formed within the machine body. This type may be called a machine of built-in mechanism.

Further, there is proposed a machine of exterior mechanism type wherein the Y-direction drive mechanism part may be folded up as shown in Japanese patent application laid open No. 2000-237478 and in US patent application laid open No. 2002/0083872A1.

In case of the machine of exterior mechanism type, the exterior attachment will make the machine body so bulky and occupy so large space. Further it is rather troublesome to connect and disconnect the attachment to and from the machine body. Further, as the Y-direction drive mechanism is located at a position higher than the upper side of the machine bed, it is rather difficult to perform the ordinary stitching operation while the attachment is connected to the machine body.

In case of the machine of exterior mechanism type wherein the Y-direction drive mechanism may be folded up, the structure is made more compact than the conventional one. But it remains unchanged that the Y-direction drive mechanism is located on the machine bed. In case the Y-direction drive mechanism is designed to be located at a lower position, it is required that the Y-direction drive mechanism is arranged side by side with the X-direction drive mechanism. This will, however, make the attachment so bulky.

On the other hand, in case of the machine of built-in mechanism type, there are no problems such as mentioned above in case of the machine of exterior mechanism type. However, the problem is that the operation range of the X-Y direction drive mechanism is limited by the size of the machine body. It is, therefore, difficult to stitch a pattern of large size.

It is, therefore, an object of the invention to solve the problems as mentioned in connection with the conventional embroidery sewing machines.

In this connection, the Y-direction drive mechanism may be formed to be turnable commonly in case of the machine of exterior mechanism type and in case of the machine of built-in mechanism type. However, the turning operation is problematical, because the Y-direction drive mechanism is normally located in the inoperative opposition as extending along the machine body and is locked there when the embroidery stitching operation is not performed. Namely, the problem is in that the machine operator is required to unlock the Y-direction drive mechanism and to simultaneously turn the same out of the inoperative opposition.

Further, it is very dangerous in case the drive motor is driven when the Y-direction drive mechanism is not just in the inoperative position, that is, in the accommodating position or not just in the operative position for embroidery stitching.

Particularly, it is difficult to confirm whether or not the Y-direction drive mechanism is just in the inoperative rest position or just in the operative position for embroidery stitching. The accident will happen if the sewing machine is driven without exact confirmation of positional situation of the Y-direction drive mechanism. Further, it must be avoided that the Y-direction drive mechanism happens to move out of the operative position while the sewing machine is driven.

SUMMARY OF THE INVENTION

The invention relates to an embroidery sewing machine for stitching embroidery patterns by moving a holder holding a work to be stitched in the X-direction that is in the width direction of the machine body and in the Y-direction that is in the depth direction of the machine body, the embroidery sewing machine comprising a bed, a base provided on the lower side of the bed, an X-direction drive mechanism arranged in the base to move the work holder in the X-direction, a connecting mechanism arranged on the rear side of the bed and connected to the X-direction drive mechanism and being movable in the X-direction, a Y-direction drive mechanism connected to the connecting mechanism and being movable in the X-direction, the Y-direction drive mechanism carrying the work holder and moving the same in the Y-direction, and being turnable between an inoperative position where the-Y direction drive mechanism extends along the rear side of the bed and has an upper side extending in a same plane with the upper side of the bed and an operative position where the Y-direction drive mechanism extends as protruding out of the rear side of the bed in the Y-direction.

According to the invention, as the Y-direction drive mechanism is not arranged within the machine body, the moving range in the Y-direction is not limited by the size of machine body. Therefore, a embroidery frame of relatively large size may be employed. Namely an embroidery pattern of relatively large size may be obtained.

Moreover, as the X-direction drive mechanism is arranged within the base on the underside of the bed of machine body, the Y-direction drive mechanism may be located in a lower position where the upper side of the Y-direction drive mechanism is in a same plane with the upper side of bed and where the Y-direction drive mechanism is not an obstacle to the ordinary stitching operation.

Further, it is preferable that the connecting mechanism is designed to have a base plate for supporting the Y-direction drive mechanism, the base plate being turnable relative to the X-direction drive mechanism and being provided with projections for engaging the groves provided on the X-direction drive mechanism at least when the Y-direction drive mechanism is turned and protruded out in the Y-direction. It is further preferable that the connecting mechanism includes a means for giving force to normally urge the base plate and the X-direction drive mechanism toward each other. With the structure as such, the Y-direction drive mechanism may be fixedly maintained in the protruded out position.

Further the Y-direction drive mechanism is turningly movable between a position where the Y-direction drive mechanism is inoperative in an accommodating space as extending in the X-direction and a position where the Y-direction drive mechanism is protruded out in the Y-direction and is operative for embroidery stitching. In this connection, the invention may include a means for locking the Y-direction drive mechanism at least in one of the operative position and the inoperative position, a means for unlocking the Y-direction drive mechanism and a means for turning the Y-direction drive mechanism a predetermined amount to one or the other of the operative position and the inoperative position when the Y-direction drive mechanism is unlocked.

With the structure as mentioned above, the means for unlocking the Y-direction drive mechanism gives a particular effect in manipulation of the Y-direction drive mechanism. Especially when the Y-direction drive mechanism is unlocked at the accommodated inoperative position, the Y-direction drive mechanism is turned a predetermined amount toward the operative position and a gap is provided between the machine body and the Y-direction drive mechanism, so that the machine operator may insert a finger into the gap and may easily move the Y-direction drive mechanism to the operative position in the Y-direction.

Further the invention may include a means for locking the Y-direction drive mechanism at least in the operative position for embroidery stitching, a means for unlocking the Y-direction drive mechanism and a sensor for giving a locking signal in response to the situation that the Y-direction drive mechanism is locked in the operative position for embroidery stitching.

In a preferred embodiment, it is preferable that the locking means includes projections, groves provided on the X-direction drive mechanism and engaging the projections when the Y-direction drive mechanism is in the operative position for embroidery stitching and a means for giving force to normally urge the base plate and the X-direction drive mechanism toward each other. It is further preferable that the unlocking means includes a means operated against the action of the force giving means to dissolve the engagement between the projections and the grooves and a sensor for giving an unlocking signal in response to dissolution of the engagement between the projections and the grooves. With the structure as such, the dissolution of locking action may be detected by disengagement between the projections and the grooves. It is, therefore, exactly detected that the Y-direction is not in the operative position for embroidery stitching and is not locked by the locking means.

Thus according to the invention, since the Y-direction drive mechanism is detected to be located in the operative position for embroidery stitching and is locked there, the correct and reliable embroidery stitching operation my be assured without inviting unfavorable elements such as operational danger, accident or damage of mechanical parts.

DETAILED DESCRIPTION OF THE PREFERRED EMBODIMENTS

Now the invention will be described in reference to the attached drawings.

Figure 1:
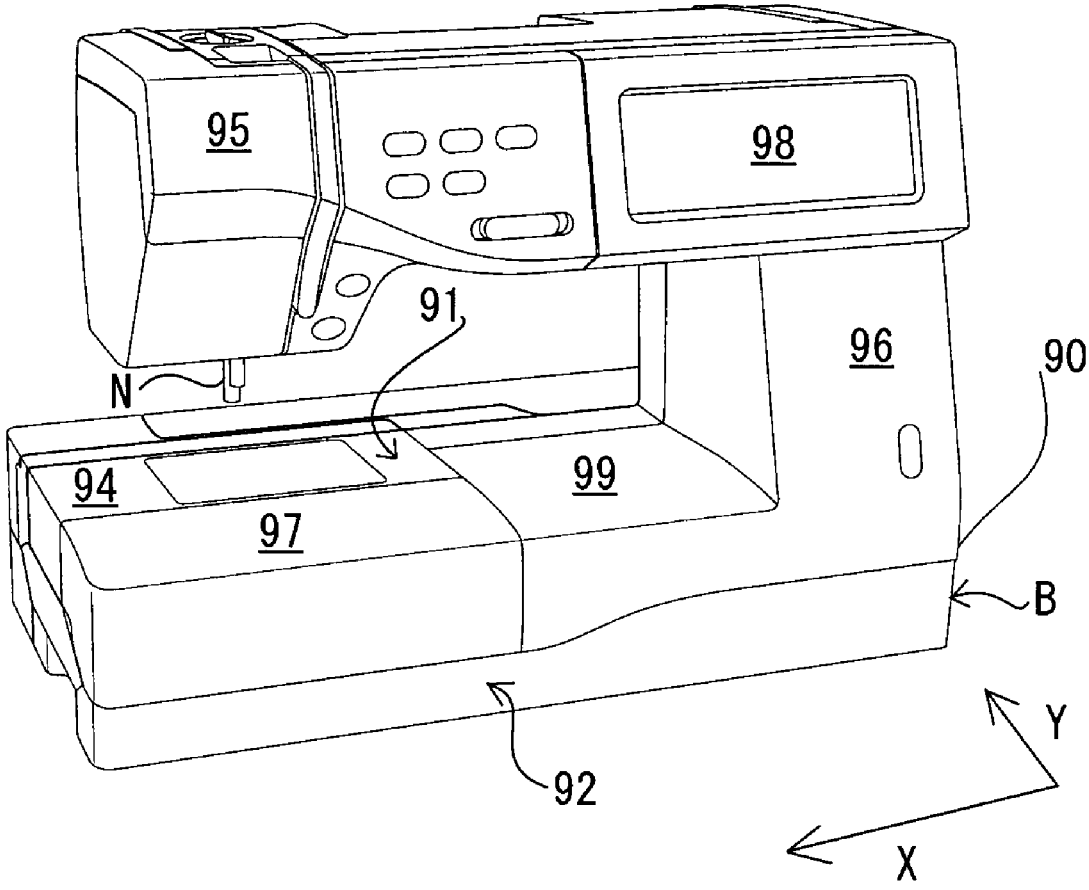
FIG. 1 is a perspective view of a sewing machine of the invention taken from the front side of the machine.

FIG. 1 is a perspective view of an embroidery sewing machine according to the embodiment of the invention taken from a machine operator who is at the position for using the sewing machine. The sewing machine has a machine body which is substantially composed of a base B, a bed 90 having a front side 92 and provided on the base B, a standard 96 standing up from the bed 90 and an arm 95 extending laterally from the standard 96. The arm 95 has an indicating part provided on the front side thereof the indicating part including a display 98 and has a needle part N provided for the normal as well as the embroidery stitching operations.

The bed 90 is composed of a free arm 94, a part 97 which may be removed from the bed 90 and a fixed part 99. These components have the upper surfaces respectively which are arranged on a same level in a same plane forming a stitch working place 91.

The free arm 94 may be used for the particular stitching operations when the removable part 97 is removed.

Incidentally as shown, the width direction of machine is called as X-direction and the depth direction of machine is called as Y-direction for convenience sake.

Figure 2:
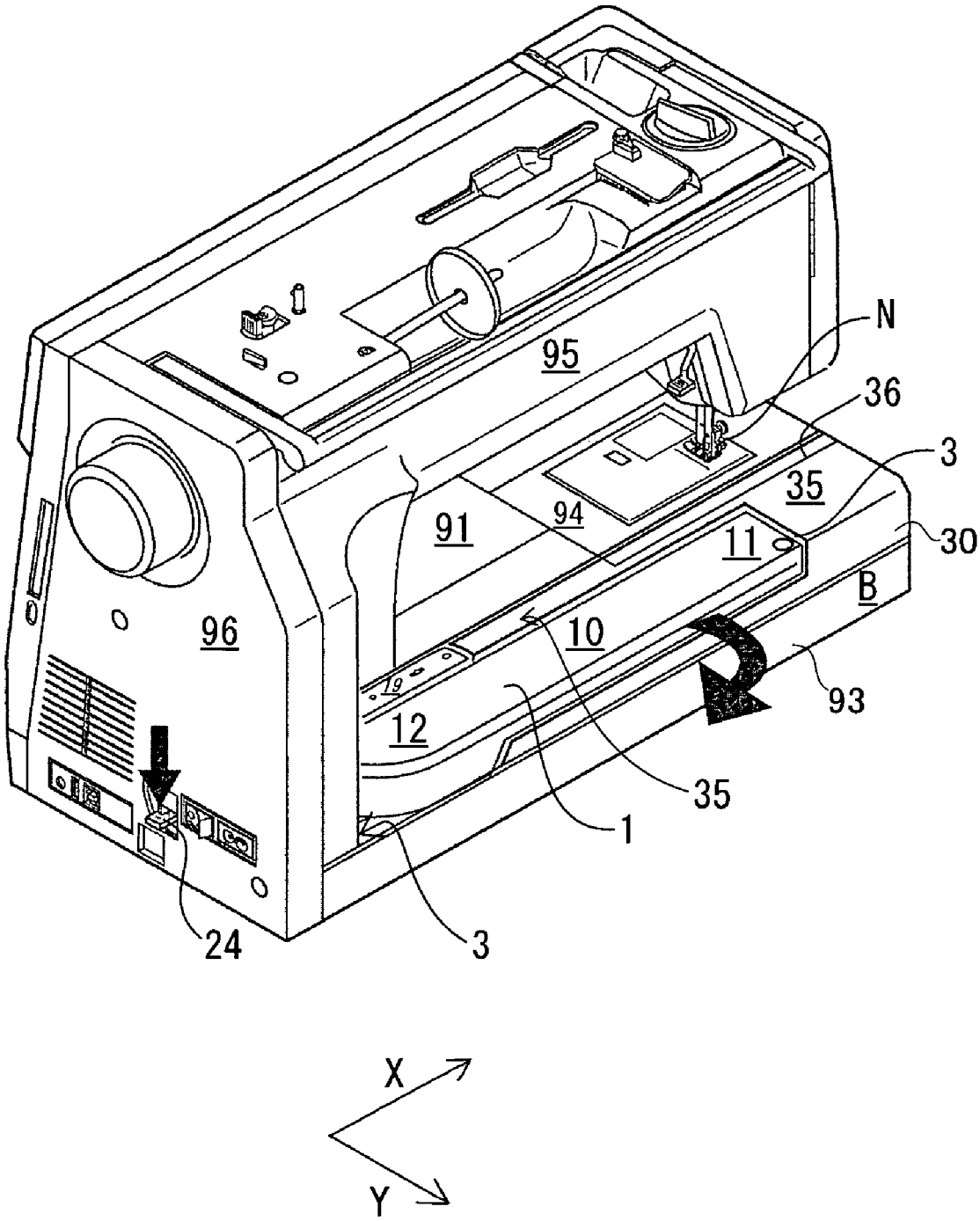
FIG. 2 is a perspective view of the sewing machine of the invention taken from the rear side of the machine.

As shown in FIG. 2, a Y-direction drive mechanism includes an elongated arm 1 which is normally arranged in the bed 90 at the rear side 93 thereof. The elongated arm 1 is arranged as accommodated in a cutout portion 3 of the bed 90 and may be moved to extend in the Y-direction so as to move an embroidery frame in the Y-direction, the embroidery frame holding a cloth to be embroidered. Further the elongated arm 1 forms a part of the machine body in the normal condition wherein the upper side 10 is located as continuous with the upper side 91 of the bed 90 at a same level and in a same plane.

Actually the elongated arm 1 may be turned in a horizontal plane to be extended in the Y direction as partly protruding from the bed 90 in the rearward direction. In this position, the elongated arm 1 may be operative with the embroidery frame attached to a support piece 19 thereof The elongated arm 1 is operatively connected to an X-direction drive mechanism 4 which is normally arranged in the machine body to move the elongated arm 1 in the X-direction that is, in the width direction. Thus the embroidery frame attached to the support piece 19 may be moved in the X-Y direction such that the embroidery stitches may be formed on the cloth held by the embroidery frame as will be described in detail hereinlater.

The cutout portion 3 of the bed 90 is formed in a shape substantially same with the outline of the elongated arm 1 in a manner that the upper side of elongated arm 1 may be at a substantially same level with the upper side 91 of the bed 90 when the elongated arm 1 is turned back into the cutout portion 3 from the protruded operative position.

In the cutout portion 3, the elongated arm 1 is operatively connected to the X-direction drive mechanism 4 so that the elongated arm 1 may be moved in the X-direction by the drive mechanism 4.

The cutout portion 3 is closed by a cover 30 with a gap 36 being left uncovered. The cover 30 is formed to have the upper side 35, 35 placed at a substantially same level with the upper side 10 of the movable arm 1 and with the upper side of the frame support piece 19.

The gap 36 is provided to enable the machine operator to effectively use the free arm 94. The gap 36 may be closed by use of an adaptor having an upper side placed at a same level with the upper side 91 of the bed 90 for the normal stitching operations.

Figure 3:
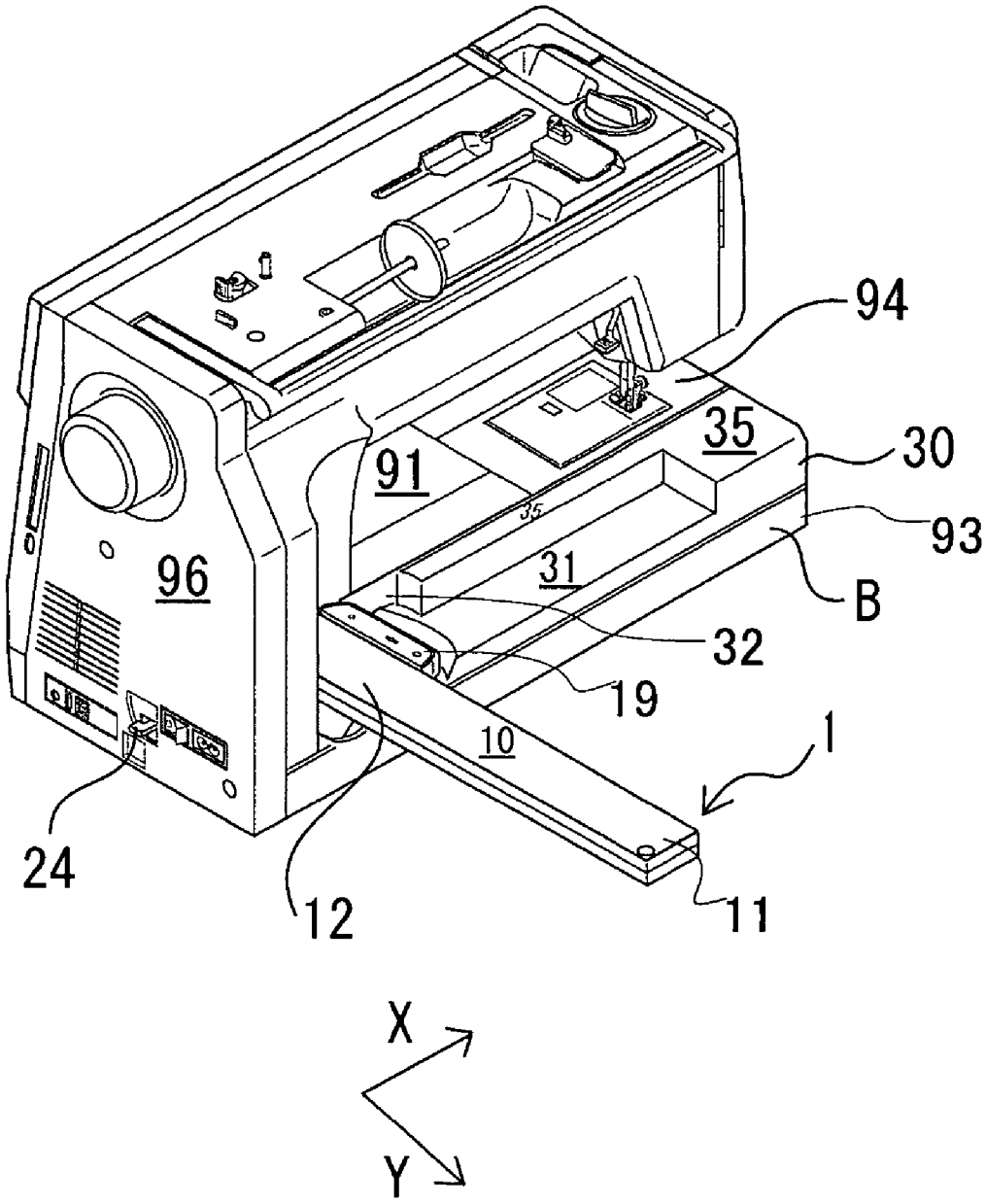
FIG. 3 is a perspective view of the sewing machine of the invention taken from the rear side of the machine to show the mode for usage.

As shown in FIG. 3, the cover 30 is provided with a cutout 31 formed to accommodate the elongated arm 1 therein and is further provided with a cutout 32 formed to receive the frame support piece 19 therein, so that the elongated arm 1 including the frame support piece 19 may be compactly accommodated in the machine body.

In this connection, the cover 30 may be moved in the X-direction together with the elongated arm 1.

The elongated arm 1 has one end formed as a base potion 12 located on the side of the standard 96 and operatively connected to the X direction drive mechanism 4. The base portion 12 has an axis around which the elongated arm 1 may be turned so that the opposite end side 11 may be moved away from the cover 30. Thus the elongated arm 1 may be extended in the Y direction on the side of the standard 96. In this condition, the embroidery frame is free of interference with the standard 96, and therefore may be made enlarged.

Figure 4:
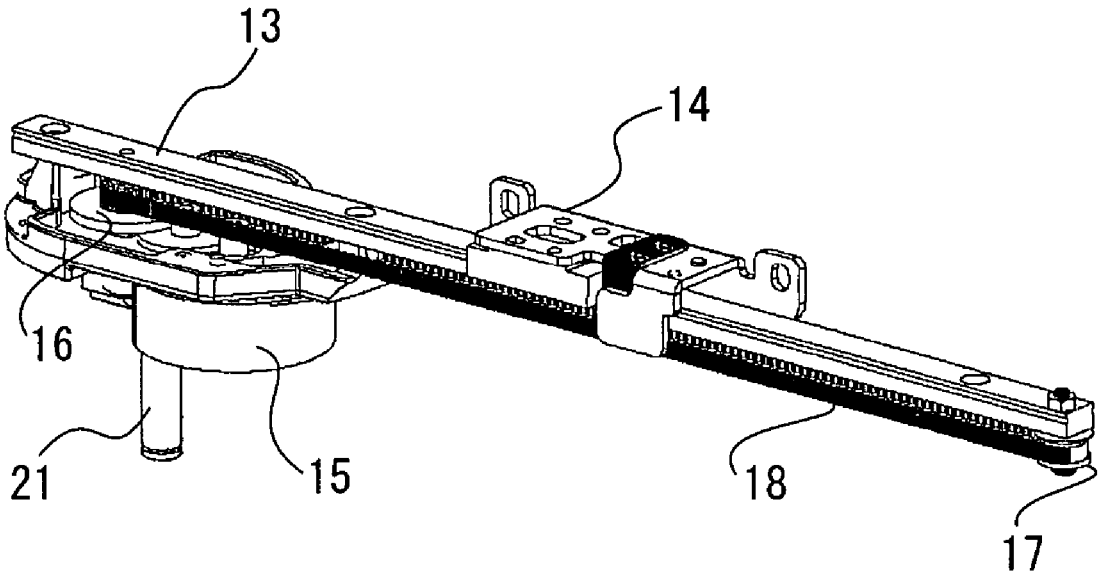
FIG. 4 is a perspective view of Y-direction drive mechanism of the invention.

The structure of the elongated arm 1 will be described in detail in reference to FIG. 4, wherein the movable arm 1 is shown as uncovered.

The elongated arm 1 is provided with a guardrail 13 on which a carriage 14 is arranged to move in the Y direction. The carriage 14 is provided to have the frame support piece 19 secured thereto, the frame support piece 19 being provided to have the embroidery frame removably secured thereto.

The carriage 14 is secured to a drive belt 18 which is provided below the guardrail 13, so that the carriage 14 may be moved as the drive belt 18 is driven.

The belt 18 is extended between a drive gear 16 and a pulley 17 as shown and is driven as the drive gear 16 is driven by a drive motor 15.

Figure 5:
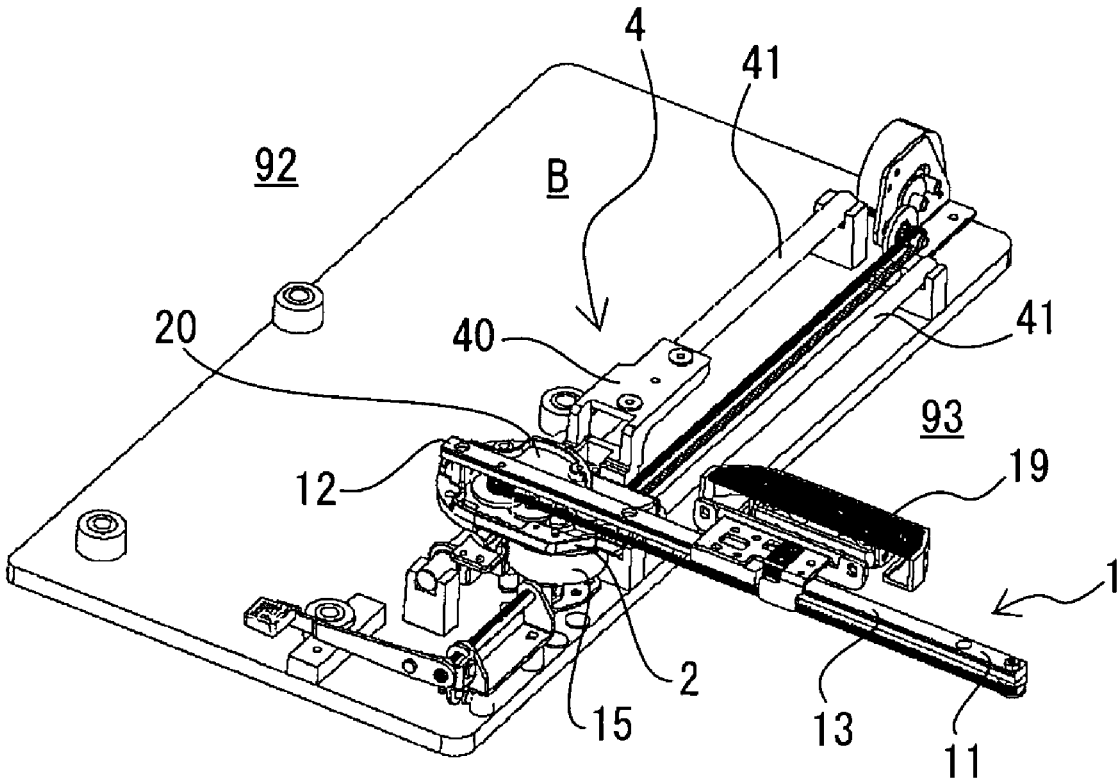
FIG. 5 is a perspective view of X-Y direction drive mechanism of the invention.

The base portion 12 of the elongated arm 1, that is, the base portion 12 of the guardrail 13 is connected to a connecting mechanism 2 including a turntable 20 which is turnable in a horizontal plane as shown in FIG. 5. The elongated arm 1 is operatively connected to the turntable 20 such that the elongated arm 1 may be turned substantially in the range of 90° together with the guardrail 13 as the turntable 20 is turned.

Figure 6:
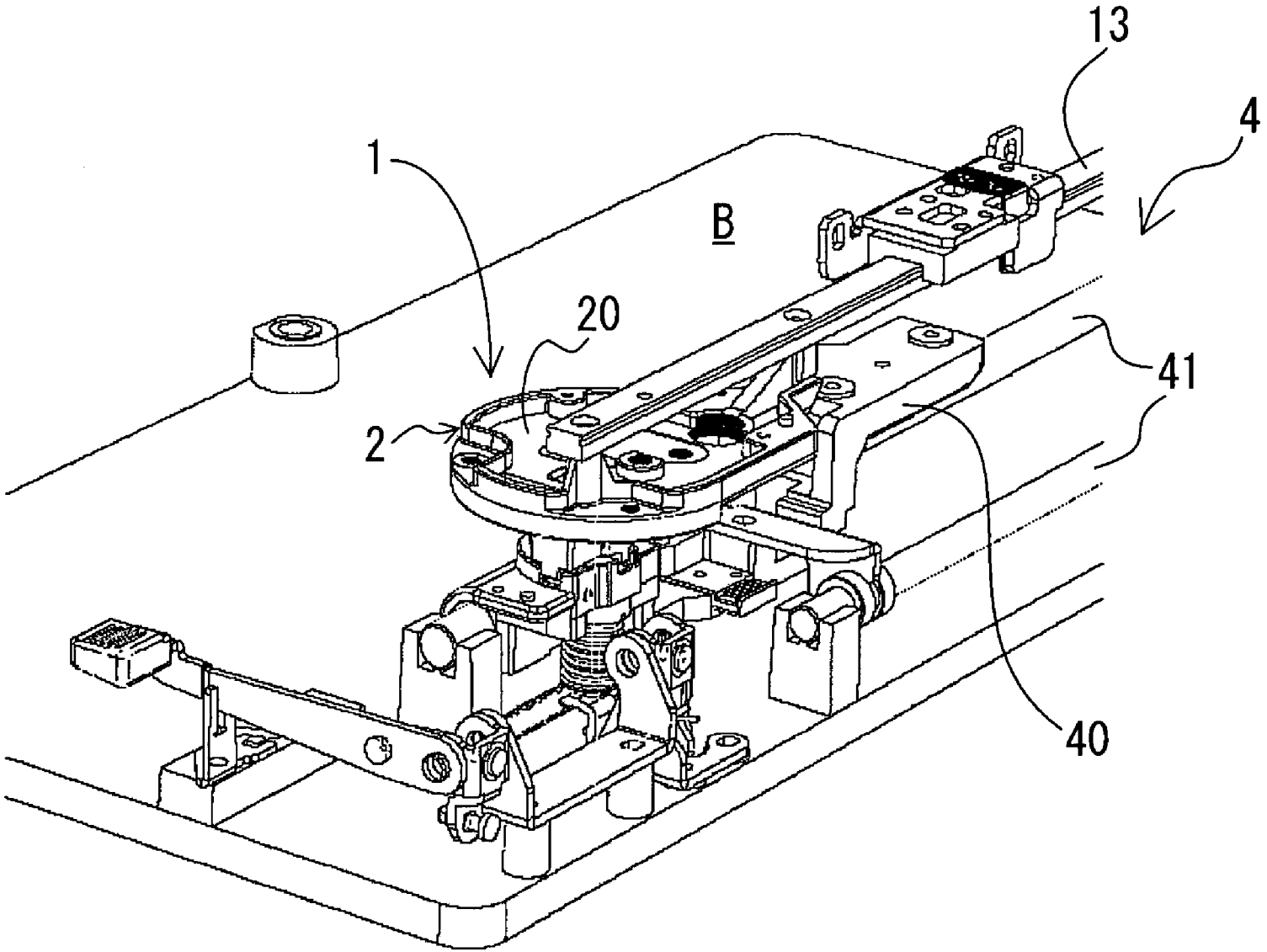
FIG. 6 is a perspective view of a connecting mechanism of the invention.

FIG. 5 shows the elongated arm 1 turned substantially 90° outwardly from the rear side 93 of the bed 90 for embroidery stitching operation. In case the embroidery stitching operation is not performed, the elongated arm 1 is turned back into the cutout 3 of the bed 90 as shown in FIG. 6.

Figure 7:
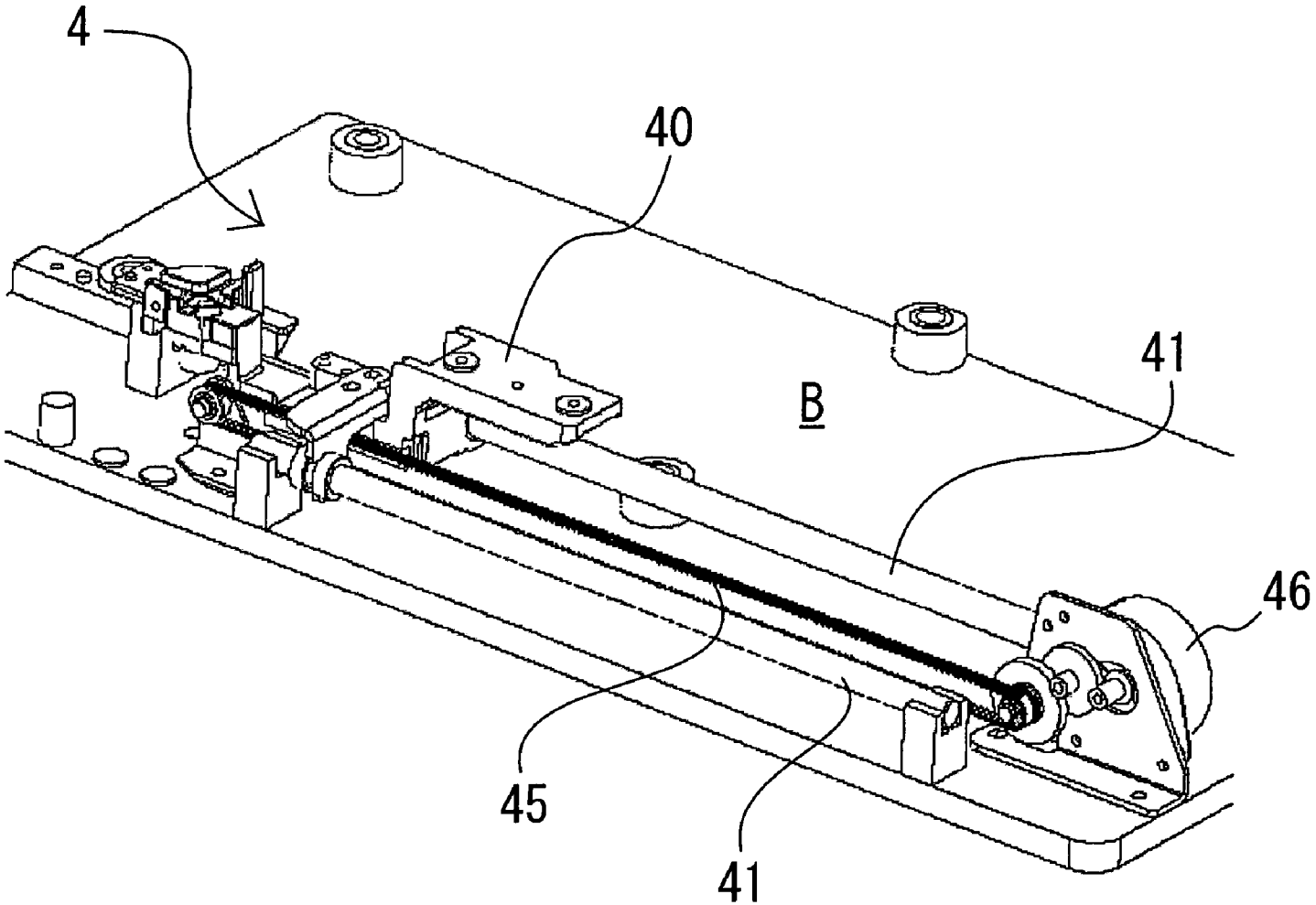
FIG. 7 is a perspective view of X-direction drive mechanism of the invention.

On the other hand, as shown in FIG. 7, the X-direction drive mechanism 4 includes a carriage 40 provided for moving the elongated arm 1 in the X direction. The carriage 40 is arranged so as to be moved as guided by two guide shafts 41, 41 extending in the X-direction substantially in parallel with each other. The carriage 40 is connected to a drive belt 45 which is driven by a drive motor 46 to move the carriage 40 in the X-direction.

The X-direction drive mechanism 4 is provided in the base B.

The aforementioned connecting mechanism 2 is provided on the carriage 40.

Figure 8:
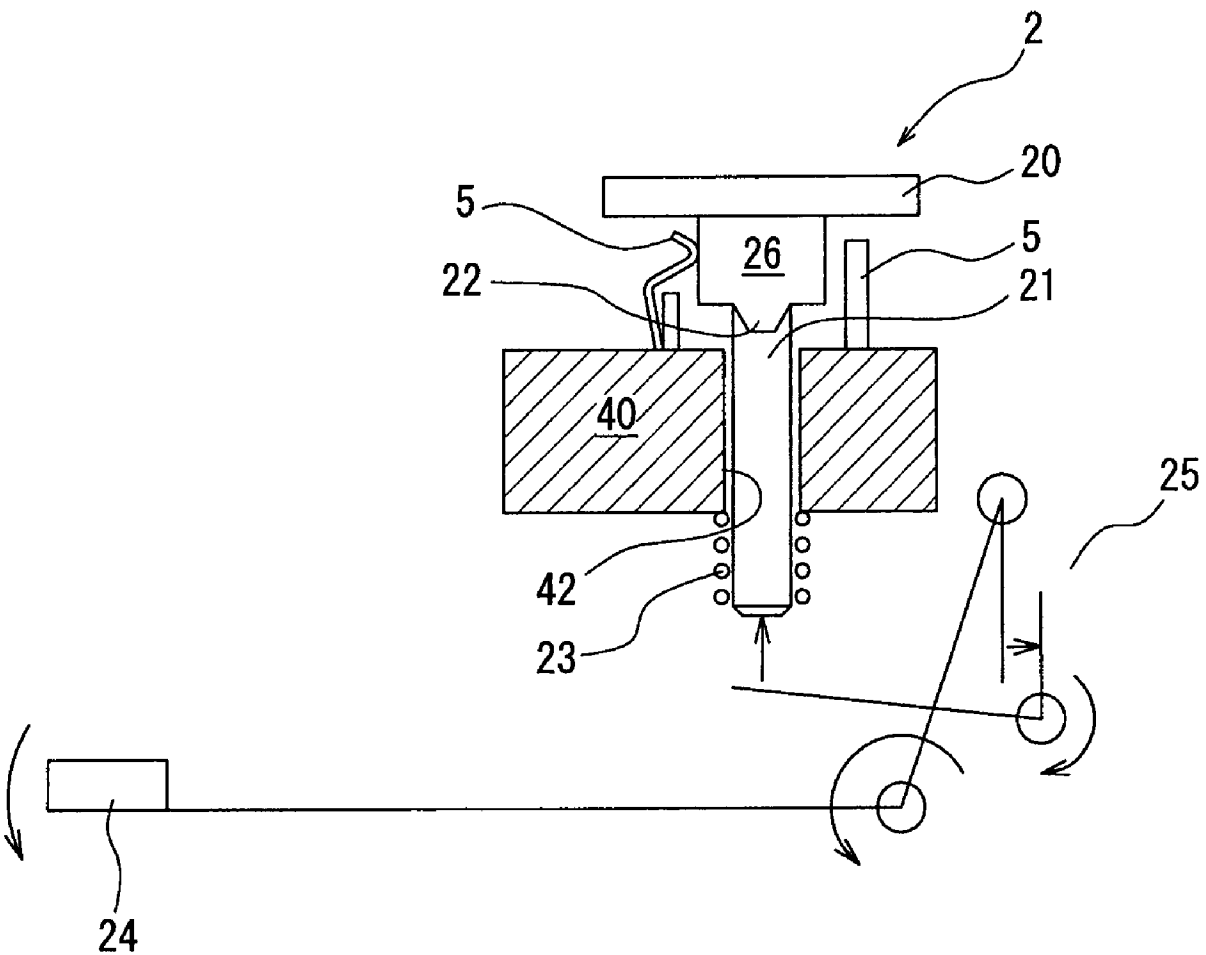
FIG. 8 is a side elevational view of essential part of the connecting mechanism shown as enlarged and partly in vertical section.
Figure 9:
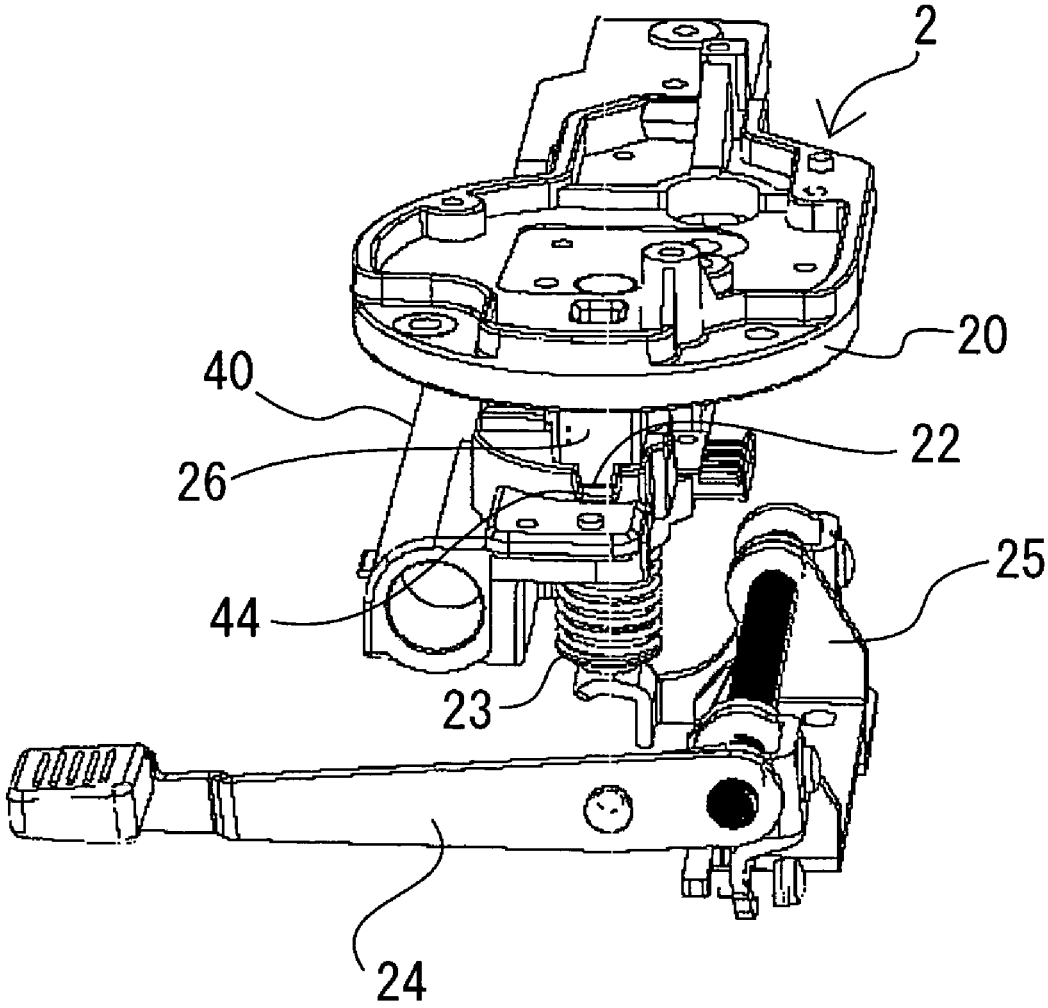
FIG. 9 is a perspective view of the connecting mechanism shown as enlarged.

As shown in FIGS. 8 and 9, the connecting mechanism 2 includes the aforementioned turntable 20 and a rotary shaft 21 which is extended through a hole formed in the carriage 40.

The turntable 20 has a substantially square block 26 formed at the lower side thereof. The block 26 is formed with a pair of projections 22, 22 on the opposite side thereof.

A tension spring 23 is provided for normally pressing down the rotary shaft 21, thereby to normally press down the turntable 20 toward the carriage 40 which has grooves 43, 44 formed thereon. The elongated arm 1 is held fixed when the projections 22, 22 are in engagement with the groove 43 or groove 44. On the other hand, the elongated arm 1 is turnable when the projections 22, 22 are out of engagement with the groove 43 or groove 44.

Figure 10:
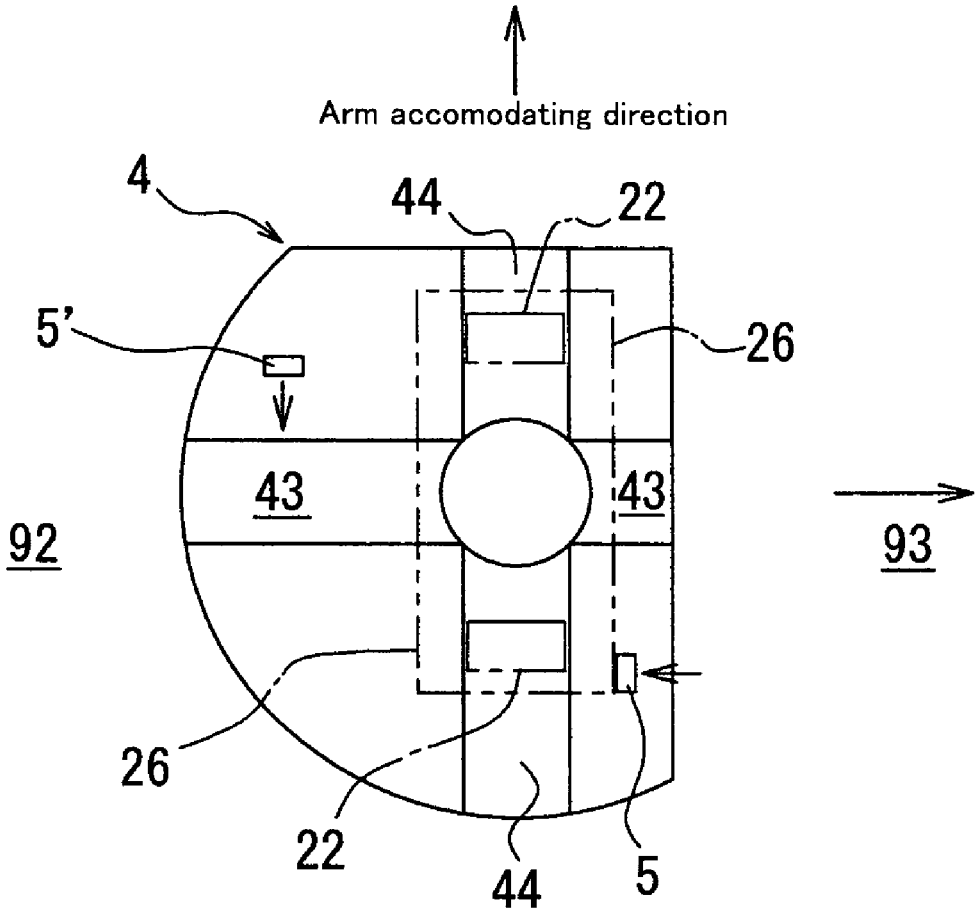
FIG. 10 is a plan elevational view of a turntable of the connecting mechanism shown as enlarged.

As particularly shown in FIG. 10, the grooves 43, 44 are formed as extending diametrically of the carriage 40 perpendicularly intersecting each other.

With the carriage 40 formed with such grooves 43, 44, the elongated arm 1, that is, the guardrail 13 may be held fixed as extended in the Y-direction in the operative position when the projections come in engagement with the groove 43. On the other hand, the elongated arm 1, that is, the guardrail 13 may be held fixed as extended in the X-direction accommodated in the cutout portion 3 of the bed 90 in the inoperative position when the projections come in engagement with the groove 44.

An operating lever 24 is provided to move the turntable 20 relative to the carriage 40. In case the operating lever 24 is pressed down, a link 25 is operated to move up the rotary shaft 21 against the tensile force of the tension spring 23. As the result, the turntable 20 is moved up and the projections 22 are disengaged from the groove 43 or 44 of the carriage 40, and becomes turnable. Therefore the elongated arm 1 is allowed to turn relative to the carriage 40. The operating lever 24 and the link 25 form a mechanism for releasing the elongated arm 1.

As particularly shown in FIG. 2, the operating lever 42 is partly protruded out of the machine body.

The carriage 40 has a pair of springs 5, 5 provided thereon. The springs 5, 5 have swells 26, 26 respectively which are pressed against the square block 26 of the turntable 20 so that the turntable 20 may be turned a predetermined amount when the turntable 20 is disengaged from the carriage 40.

As shown in FIG. 10, the spring 5 is arranged at a position for giving pressure to the square block 26 when the elongated arm 1 is accommodated in the cutout portion 3 of the bed 90, that is, in the inoperative position. The pressure is given in the direction for allowing the elongated arm 1 to turn into the operative position for embroidery stitching where the elongated arm 1 is protruded to the rear side 93 of the bed 90.

On the other hand, the other spring 5' is arranged at a position for giving pressure to the square block 26 when the elongated arm 1 is in the operative position for embroidery stitching. The pressure is given in the direction for allowing the elongated arm 1 to turn into the inoperative position, that is, into the cutout portion 3 of the bed 90 that is the arm accommodating space.

Figure 11:
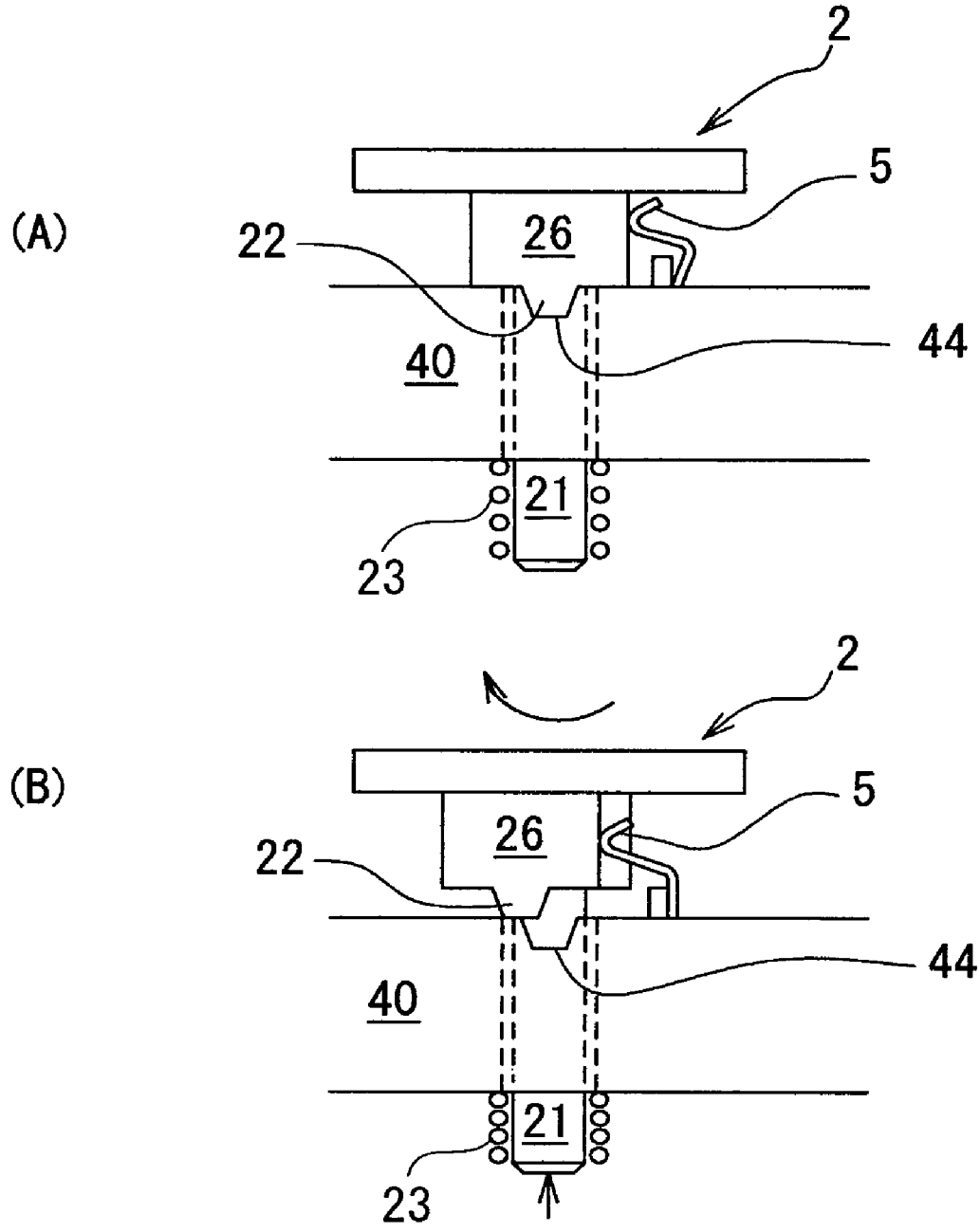
FIG. 11 shows side elevational views of essential part of the connecting mechanism, showing the conditions for establishing and dissolving the relation between the X and Y direction drive mechanisms respectively.

In case the elongated arm 1 is located in the inoperative position, that is, in the cutout portion 3 of the bed 90 as shown in FIG. 2, the projections 22, 22 are in engagement with the grooves 44,44 as shown in FIG. 11(A). In this condition, when the operating lever 24 is pushed up, the rotary shaft 21 is moved up and the projections 22, 22 are disengaged from the grooves 44, 44. Simultaneously the turntable 20 is turned a predetermined amount by the action of spring 5 giving pressure to the square block 26 as shown in FIG. 11(B).

Figure 12:
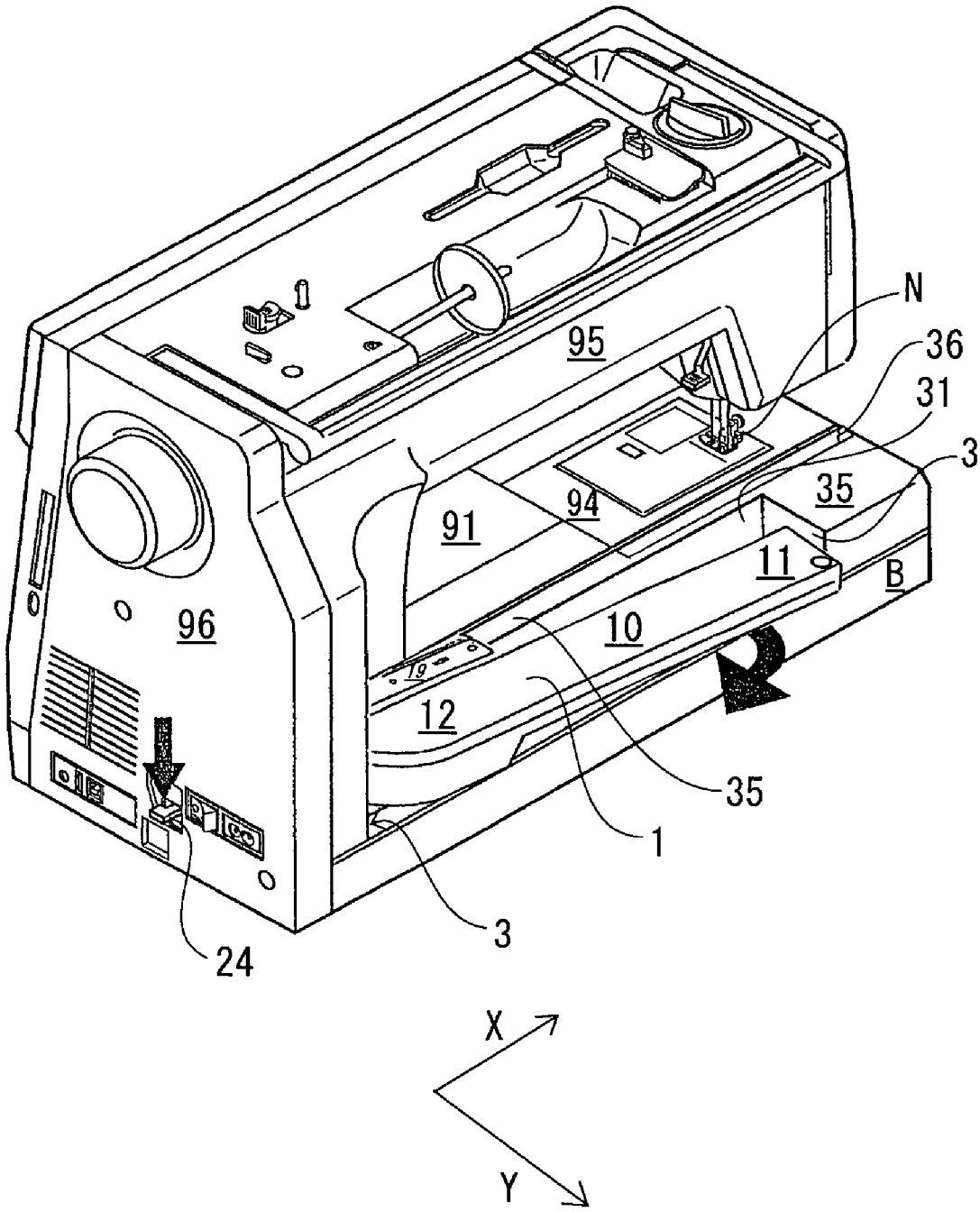
FIG. 12 is a perspective view of the sewing machine of the invention showing the Y-direction drive mechanism which is moved to an operative position for embroidery stitching.

Precisely, as shown in FIG. 12, the elongated arm 1 is turned and slightly moved out of the arm accommodating space 31. As the result, a gap is provided between the arm accommodating space 31 and the elongated arm 1. In this condition, the machine operator is able to put a finger into the gap and pull out the elongated arm 1 to the operative position for embroidery stitching.

Incidentally, as shown in FIG. 11(B), the projections 22, 22 are pressed against the upper flat surface of the carriage 40 when the projections 22, 22 are disengaged from the grooves 44, 44 by operation of the operating lever 24. Therefore the projections 22, 22 will not be back to engage the grooves 44, 44 when the operating lever 24 is released.

This is the same in case the elongated arm 1 is moved back into the arm accommodating space 31 from the operative position.

With the structure as mentioned above, the elongated arm 1 is located in the cutout portion 3, that is, in the arm accommodating space 31 as shown in FIG. 2 when the ordinary stitching operation is performed. In this condition, the upper side 10 of the elongated arm 1 is at the same level with the upper side 91 of the bed 90 in a same plane. Therefore the upper side of the bed 90 may be enlarged as a flat stitch working place together with the upper side 35, 35 of the cover 30 and the upper side of the frame support piece 19.

In case the embroidery stitching operation is performed, the elongated arm 1 is turned about 90° to extend in the Y-direction as shown in FIG. 3 and the embroidery frame (not shown) is attached to the frame support piece 19. In this connection, the elongated arm 1 may be made to extend longer in the Y-direction irrespectively of the length of the machine body in the Y-direction, so that the moving amount of the embroidery frame may be increased along the more elongated arm 1. Thus a pattern of so large size may be obtained.

Further the elongated arm 1 may be exactly fixed to the predetermined positions due to the structure of the connecting mechanism 2. With downward operation of the operating lever 24, the rotary shaft 21 is pushed up and the projections 22, 22 are disengaged from the grooves 43, 43 or from the grooves 44, 44. Simultaneously the square block 26 is pressed by the spring 5, and then the turntable 20 is turned for a predetermined amount and the projections 22, 22 are pressed against the flat surface of the carriage 40. Therefore the projections 22, 22 will not be back to engage the grooves 44, 44 when the operating lever 24 is released.

Figure 13:
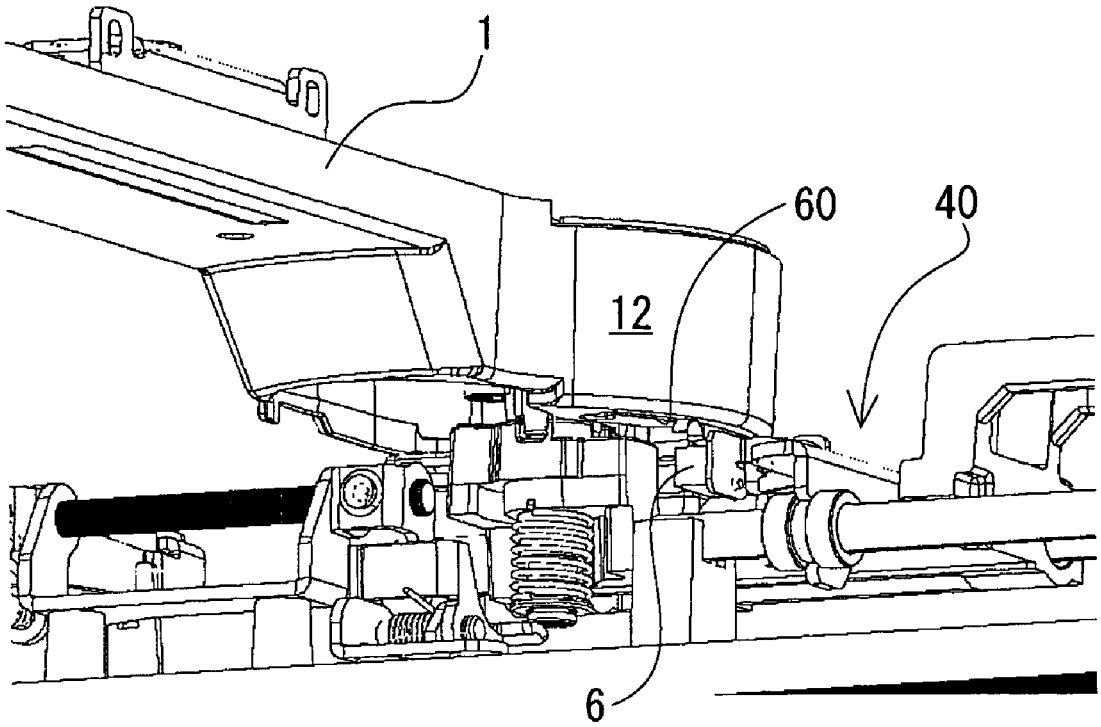
FIG. 13 is an explanatory view of a microswitch according to the invention.
Figure 14:
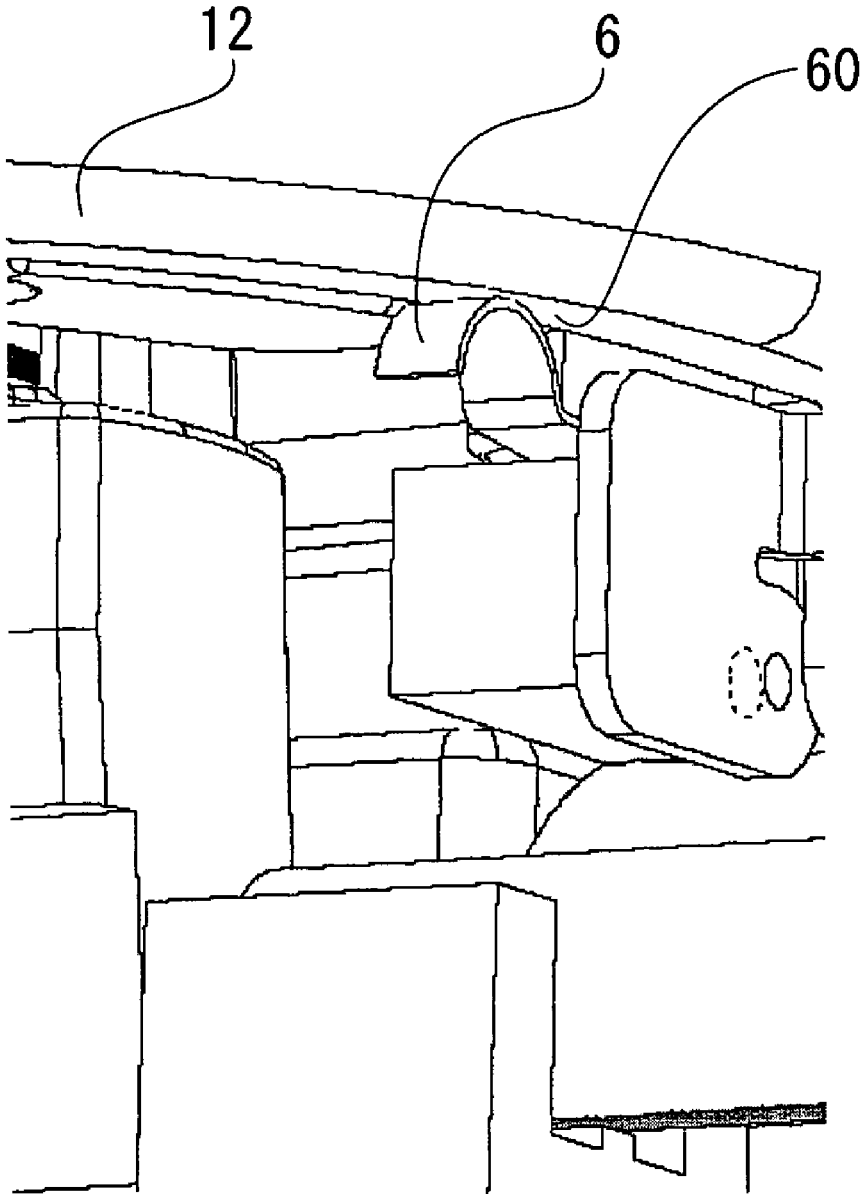
FIG. 14 is an explanatory view of the microswitch shown as enlarged.

Further according to the invention, a microswitch 6 is provided on the carriage 40 as shown in FIGS. 13 and 14. The microswitch 6 is positioned so as to be actuated by a striker 60 which is formed to extend to under the base portion 12 of the elongated arm 1.

The microswitch 6 may be turned on by the striker 60 when the elongated arm 1 is located in the operative position for embroidery stitching while the rotary shaft 21 is pressed down and the projections 22, 22 are in engagement with the grooves 43, 43 as shown in FIGS. 13 and 14.

The microswitch 6 is turned off when the rotary shaft 21 is moved up.

Figure 15:
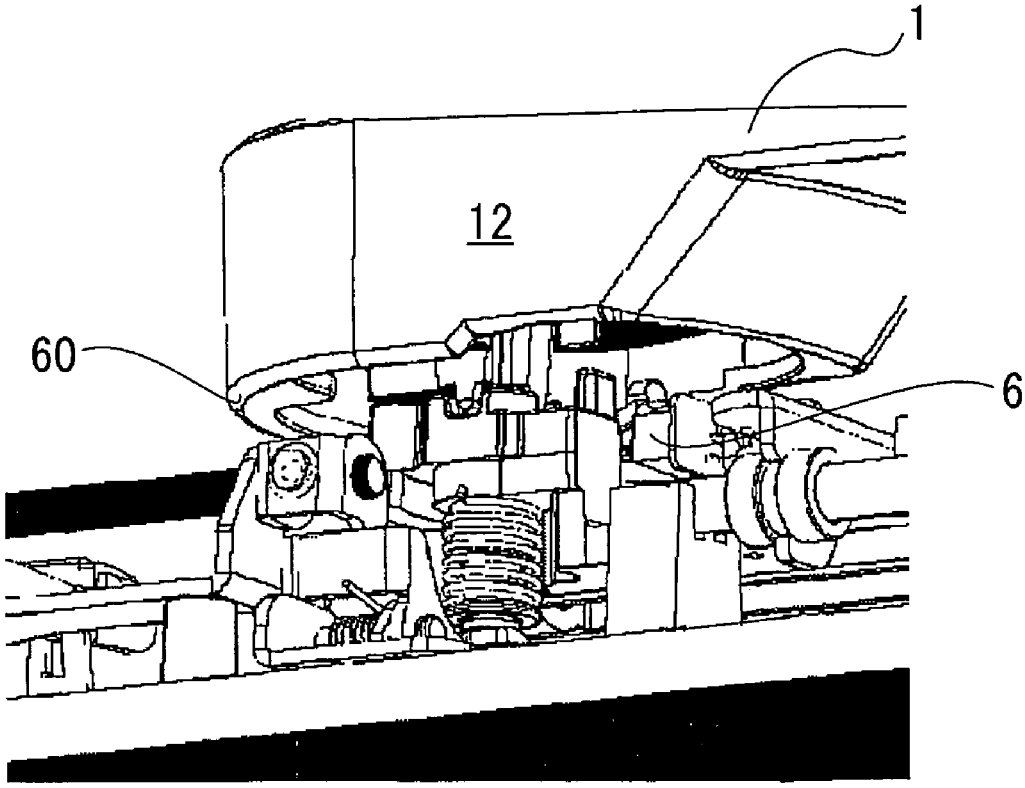
FIG. 15 is an explanatory view of the microswitch to be actuated.

Further as shown in FIG. 15, when the elongated arm 1 is not located in the operative position, the striker 60 is free from the elongated arm 1 and remains off.

With the structure as mentioned above, as shown in FIGS. 13 and 14, the microswitch 6 is turned on when the elongated arm 1 is in the operative position for embroidery stitching where the rotary shaft 21 is pressed down and engagement is established between the projections 22,22 and the groves 43, 43. On the other hand, when the rotary shaft 21 is pushed up, the microswitch 6 is turned off. Further as shown in FIG. 15, the microswitch 6 is turned off when the elongated arm 1 is not in the operative position for embroidery stitching.

According to the invention, the on and off signals of the microswitch 6 are used to control the operation of the X-drive motor 46 and the Y-drive motor 15.

Figure 16:
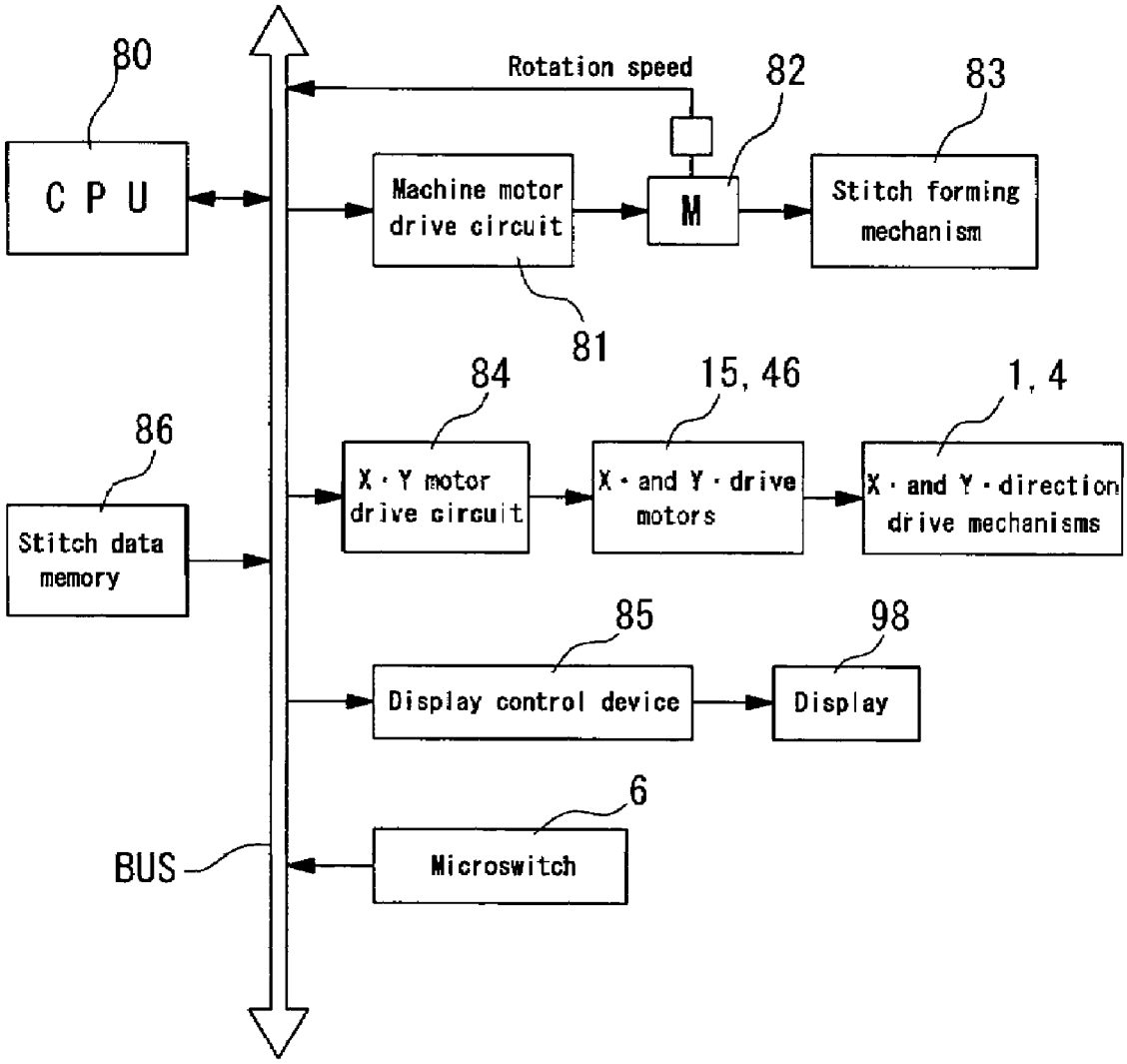
FIG. 16 is a block diagram showing the functions of the invention.

In FIG. 16 showing the functions of the invention, the CPU 80 is used to control the operation of the sewing machine. Namely the X-drive motor 46 and the Y-drive motor 15 are driven under control of the stitch data which are read out from the stitch data memory 86 and thus control the operation of the X-direction drive mechanism 4 and the Y-direction drive mechanism 2, that is, the X-Y direction drive mechanism including the elongated arm 1 for stitching embroidery patterns while the stitch forming mechanism 83 is operated by the machine drive motor 82 which is regulated by the machine motor drive circuit 81.

The on-and off-signals of the microswitch 6 are transmitted to the CPU 80. The CPU 80 is responsive to the on-signal of the microswitch 6 to drive the X-and Y-drive motors 15, 46 through the X-Y motor drive circuit 84.

The CPU 80 is responsive to the off signal of the microswitch 6 to prohibit the X-and Y-drive motors 15, 46 from driving and stop the machine drive motor 82. Thus the embroidery stitching operation is stopped. Simultaneously the CPU 80 controls the indicating device including the display 98 to indicate the situation thereat. The embroidery stitching operation may be started again when the elongated arm 1 is returned to the operative position in the Y-direction.

With the structure of the invention as mentioned above, the embroidery stitching operation is prohibited in case the elongated arm 1 is not placed in the operative position in the Y-direction and in case the operating lever 24 is operated by mistake when the elongated arm 1 is placed in the operative position. Thus the accidents or the damages machine elements may be prevented in connection with the embroidery stitching operation. Incidentally, it is preferable that the operating lever 24 is covered or locked while the embroidery stitching operation is performed.

What is claimed is:

1. An embroidery sewing machine for stitching embroidery patterns by moving a holder holding a work to be stitched in X-direction that is in the width direction of the machine body and in Y-direction that is in the depth direction of the machine body, the embroidery sewing machine comprising; a base provided on the lower side of the bed, an X-direction drive mechanism arranged in the base to move the work holder in the X-direction, a connecting means arranged on the rear side of the bed and connected to the X-direction drive mechanism and being movable in the X-direction, a Y-direction drive mechanism for carrying the work holder and moving the same in the Y-direction connected to the connecting means and being movable in the X-direction, said Y-direction drive mechanism being turnable between a position where the Y-direction drive mechanism extends along the rear side of the bed in the X-direction and a position where the Y-direction drive mechanism protrudes out of the rear side of the bed in the Y-direction, and said Y-direction drive mechanism having an upper side extending in a same plane with the upper side of the bed when the Y-direction drive mechanism is in said position where it extends along the rear side of the bed in the X-direction.

2. The embroidery sewing machine as defined in claim 1, wherein the rear side of the bed has a cutout formed thereat for accommodating the Y-direction drive mechanism, wherein the connecting means is exposed in the cutout, and wherein the Y-direction drive mechanism is accommodated in the cutout when the Y-direction drive mechanism is turned into the position where the Y-direction drive mechanism extends along the rear side of the bed.

3. The embroidery sewing machine as defined in claim 1, wherein the machine body includes a standard standing up from the bed and wherein the Y-direction drive mechanism is connected to the connecting means on the side of the standard.

4. The embroidery sewing machine as defined in claim 1, wherein the Y-direction drive mechanism is of a substantially same length with the length of the machine body in the width direction thereof.

5. The embroidery sewing machine as defined in claim 1, wherein the connecting mechanism includes; a turntable for supporting the Y direction drive mechanism and being turnable relative to the X-direction drive mechanism, projecting means provided on the turntable, groove means provided on the X-direction drive mechanism, said groove means arranged to engage the projecting means when the Y-direction drive mechanism is located as extending in the Y-direction, a means for normally giving force for urging the turntable and the X-direction drive mechanism toward each other.

6. The embroidery sewing machine as defined in claim 5, further comprising an operating means operated against the force of the force giving means to dissolve the engagement between the projecting means and the groove means.

7. The embroidery sewing machine as defined in claim 1, wherein the Y-direction drive mechanism includes an elongated arm which may be moved between an inoperative position where the elongated arm extends in the X-direction and an operative position where the elongated arm extends in the Y-direction for embroidery stitching operation, and further comprising; a means for locking the elongated arm at least in one of the operative and inoperative positions, a means for dissolving the action of the locking means, a turntable operated in response to dissolution of the action of the locking means to turn the elongated arm a predetermined amount toward the other of the operative position and the inoperative position.

8. The embroidery sewing machine as defined in claim 7, wherein the locking means includes; projecting means provided on the Y-direction drive mechanism, groove means provided on the X-direction drive mechanism and arranged to engage the projecting means when the elongated arm is located at least one of the operative and inoperative positions, a means normally giving force for urging the projecting means and the groove means toward each other to establish engagement between the both members, and wherein the dissolving means is operated against the action of the force giving means to dissolve the engagement between the projecting means and the groove means, and wherein the turntable is operated in response to dissolution of the engagement between the projecting means and the groove means to move the elongated arm 1 to a position where the projecting means and the groove means are disengaged from each other.

9. The embroidery sewing machine as defined in claim 7, wherein the turntable is operated to turn the elongated arm under the action of spring means.

10. The embroidery sewing machine as defined in claim 1, wherein the Y-direction drive mechanism is turnable between a position where the Y-direction drive mechanism is inoperative as extending in the X-direction in an arm accommodating space and a position where the Y-direction drive mechanism is operative as protruding from the arm accommodating space and extending in the Y-direction for embroidery stitching, and further comprising a means for locking the Y-direction drive mechanism at least in the operative position in the Y-direction, a means for dissolving the locking action of the locking means, a sensor operated to give a lock signal in response to the situation that the Y-direction drive mechanism is located in the operative position and is locked therein by the locking means.

11. The embroidery sewing machine as defined in claim 10, further comprising a sensor for giving an output with detection of the elongated arm being dissolved from the lock by the locking means.

12. The embroidery sewing machine as defined in claim 11, wherein the locking means includes; projecting means provided in the Y-direction drive mechanism, groove means provided in the X-direction drive mechanism and engaging the projecting means when the elongated arm is located in the operative position for embroidery stitching a means normally giving force for urging the projecting means and the groove means toward each other to establish engagement between the both means, and wherein the dissolving means includes a means which is operated against the action of the force giving means to disengage the projecting means and the groove means from each other, and further comprising a sensor operated to give a dissolution signal in response to the situation that the projecting means and the groove means are disengaged from each other.

13. An embroidery sewing machine for stitching embroidery patterns by moving a holder holding a work to be stitched in X-direction that is in the width direction of the machine body and in Y direction that is in the depth direction of the machine body, the embroidery sewing machine comprising; an X-direction drive mechanism for moving the work holder in the X-direction, a Y-direction drive mechanism for carrying the work holder and moving the same in the Y-direction, the Y-direction drive mechanism being connected to the X-direction drive mechanism so as to be moved thereby in the X-direction, and being turnable between a position where the Y-direction drive mechanism is inoperative as extending in the X-direction and a position where the Y-direction drive mechanism is operative as protruding out to extend in the Y-direction for embroidery stitching, a means for locking the Y-direction drive mechanism when the latter is at least in one of the inoperative position and the operative position, a means for dissolving the locking action of the locking means, a turntable operated in response to dissolution of the locking action of the locking means to turn the elongated arm a predetermined amount toward the other of the operative position and the inoperative position.

14. The embroidery sewing machine as defined in claim 13, wherein the locking means includes; projecting means provided in the Y-direction drive mechanism, groove means provided in the X-direction drive mechanism so as to be engaged by the projecting means while the Y-direction drive mechanism is located in any one of the operative position and the inoperative position, a means normally giving force for urging the projecting means and the groove means toward each other to establish engagement between the both means, and wherein the dissolving means is operated against the action of the force giving means to dissolve the engagement between the projecting means and the groove means, and the turntable is operated in response to dissolution of the engagement between the projecting means and the groove means to turn the Y-direction drive mechanism a predetermined amount to a position where the projecting means is out of engagement with the groove means.

15. The embroidery sewing machine as defined in claim 13, wherein the turntable is provided with spring means for turning the Y-direction drive mechanism.

16. An embroidery sewing machine for stitching embroidery patterns by moving a holder holding a work to be stitched in X-direction that is in the width direction of the machine body and in Y direction that is in the depth direction of the machine body, the embroidery sewing machine comprising; an X-direction drive mechanism for moving the work holder in the X-direction, a Y-direction drive mechanism for carrying the work holder and moving the same in the Y-direction, the Y-direction drive mechanism being connected to the X-direction drive mechanism so as to be moved thereby in the X-direction, and being turnable between a position where the Y-direction drive mechanism is inoperative as extending in the X-direction and a position where the Y-direction drive mechanism is operative as protruding out to extend in the Y-direction for embroidery stitching, a means for locking the Y-direction drive mechanism when the latter is at least in one of the inoperative position and the operative position, a means for dissolving the locking action of the locking means, a sensor operated to give a lock signal in response to the situation that the Y-direction drive mechanism is located in the operative position and is locked therein by the locking means.

17. The embroidery sewing machine as defined in claim 16, further comprising a sensor operated to give an output in response to dissolution of the locking action of the locking means.

18. The embroidery sewing machine as defined in claim 16, wherein the locking means includes; projecting means provided in the Y-direction drive mechanism, groove means provided in the X-direction drive mechanism so as to be engaged by the projecting means while the Y-direction drive mechanism is located in the operative position for embroidery stitching, a means normally giving force for urging the projecting means and the groove means toward each other to establish engagement between the both means, and wherein the dissolving means includes a means which is operated against the action of the force giving means to dissolve the engagement between the projecting means and the groove means, and further comprising a sensor operated to give a dissolution signal in response to the situation that the projecting means and the groove means are disengaged from each other.

* * * * *